US007621258B2

(12) United States Patent
Heinz et al.

(10) Patent No.: US 7,621,258 B2
(45) Date of Patent: Nov. 24, 2009

(54) INJECTOR OF A FUEL INJECTION SYSTEM OF AN INTERNAL COMBUSTION ENGINE

(75) Inventors: Rudolf Heinz, Renningen (DE); Wolfgang Stoecklein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 313 days.

(21) Appl. No.: 11/719,424

(22) PCT Filed: Nov. 22, 2005

(86) PCT No.: PCT/EP2005/056138

§ 371 (c)(1),
(2), (4) Date: May 16, 2007

(87) PCT Pub. No.: WO2006/067015

PCT Pub. Date: Jun. 29, 2006

(65) Prior Publication Data

US 2009/0145404 A1 Jun. 11, 2009

(30) Foreign Application Priority Data

Dec. 22, 2004 (DE) ..... 10 2004 061 800

(51) Int. Cl.
*F02M 47/02* (2006.01)

(52) U.S. Cl. ..... 123/467; 239/88

(58) Field of Classification Search ..... 123/467; 239/88–96

See application file for complete search history.

(56) References Cited

U.S. PATENT DOCUMENTS

| | | | | |
|---|---|---|---|---|
| 3,913,537 | A * | 10/1975 | Ziesche et al. | 123/484 |
| 4,653,455 | A * | 3/1987 | Eblen et al. | 123/506 |
| 4,662,338 | A * | 5/1987 | Itoh et al. | 123/467 |
| 5,413,076 | A * | 5/1995 | Koenigswieser et al. | 123/446 |
| 6,250,563 | B1 | 6/2001 | Frank et al. | |
| 6,378,502 | B1 * | 4/2002 | Betz | 123/467 |
| 6,691,935 | B1 * | 2/2004 | Potz et al. | 239/533.9 |
| 6,725,841 | B1 * | 4/2004 | Boecking | 123/467 |
| 7,051,958 | B2 * | 5/2006 | Sander-Potz et al. | 239/533.2 |
| 7,316,361 | B2 * | 1/2008 | Magel | 239/89 |
| 2003/0222158 | A1 * | 12/2003 | Boehland et al. | 239/533.2 |
| 2004/0055562 | A1 * | 3/2004 | Stewart et al. | 123/299 |
| 2004/0069274 | A1 | 4/2004 | Brenk et al. | |
| 2004/0129804 | A1 * | 7/2004 | Potz et al. | 239/533.2 |
| 2005/0224598 | A1 * | 10/2005 | Potz et al. | 239/88 |
| 2006/0091233 | A1 * | 5/2006 | Dutt | 239/88 |

FOREIGN PATENT DOCUMENTS

| | | | |
|---|---|---|---|
| WO | 2005/015003 | A1 | 2/2005 |
| WO | 2005-019638 | A1 | 3/2005 |

* cited by examiner

*Primary Examiner*—Thomas N Moulis
(74) *Attorney, Agent, or Firm*—Ronald E. Greigg

(57) ABSTRACT

An injector with a double-switching control valve in which a valve body is guided in the housing of the control valve in a way that reduces the wear on a valve cone of the valve body and on a first valve seat in the housing of the control valve.

20 Claims, 6 Drawing Sheets

Section A-A

INJECTOR OF A FUEL INJECTION SYSTEM OF AN INTERNAL COMBUSTION ENGINE

CROSS-REFERENCE TO RELATED APPLICATION

This application is a 35 USC 371 application of PCT/EP 2005/056138 filed on Nov. 22, 2005.

BACKGROUND OF THE INVENTION

Field of the Invention

The invention relates to an injector for an internal combustion engine, having a control valve for opening and closing a nozzle needle; the control valve has a valve body with a valve cone that cooperates with a valve seat of a housing of the control valve. In this injector, a closing spring presses the valve body against a plunger of an actuator and is centered by means of the valve seat.

In an injector for an internal combustion engine, having a control valve for opening and closing a nozzle needle—where the control valve includes a housing and an actuator, the housing contains a stepped bore with a spring chamber for accommodating a valve body, one section of the stepped bore is embodied as an inlet, and another section of the stepped bore is embodied as an outlet—and having a first valve seat, where the valve body is equipped with a valve cone that cooperates with the first valve seat and the valve body is pressed against the plunger of an actuator by a closing spring contained in the spring chamber, according to the invention, the valve body is guided in at least one section of the stepped bore and in this section, one or more passages is/are provided for the control quantity of the injector.

SUMMARY AND ADVANTAGES OF THE INVENTION

The fact that the valve body of the injector of the invention is guided in at least one section of the stepped bore assures that the valve cone of the valve body always comes into contact with the valve seat of the housing in an approximately centered, low-slippage fashion. This avoids local overstressing of the valve cone and valve seat and also reduces wear on the valve cone and valve seat. Both effects result in the fact that the valve stroke changes only slightly during operation of the internal combustion engine so that the operating behavior of the engine remains approximately the same over the entire service life. In this connection, the play between the stepped bore and the guide section of the valve body should be selected to be large enough that in the closed position of the control valve, the valve body is centered in relation to the valve seat of the housing because only then does the control valve close tightly.

In advantageous variants of the injector according to the invention, an inlet of the control valve communicates with a control chamber of the injector while an outlet of the control valve communicates with a fuel return.

In another advantageous embodiment of the invention, the closing spring acts on the valve body in the direction opposite from the actuating direction of the actuator. This assures that the valve body always assumes a definite position and the control valve is closed when the actuator is switched into the currentless state.

It has turned out to be advantageous if the closing spring is supported at least indirectly against the housing and a spring plate of the valve member.

Preferably, the guidance of the valve body occurs in the region of the outlet and/or in the region of the spring chamber. It is alternatively possible for the valve body to be guided on the spring plate or for a sleeve to be provided in the spring chamber and for the valve body to be guided by the sleeve.

In order for the control quantity of the control valve according to the invention to be able to flow through despite the guidance of the valve body in the housing, the passages can alternatively be embodied as grooves, flattened regions, and/or longitudinal bores extending in the longitudinal direction of the valve body. This can reduce the flow resistance of the control valve in the open state to such an extent that the function of the injector is not impaired by the guidance of the valve body in the stepped bore.

In order to simplify manufacturing and assembly, the housing can be comprised of two parts. In this case, the control valve can be either embodied as a separate component or can be integrated into the injector. In the latter instance, the housing of the control valve is simultaneously also the housing of the injector.

The control valve can be advantageously embodied in the form of a ⅔-way control valve. This makes it easier to implement multiple injections and offers additional possibilities for shaping the injection curve.

In order to make the best use of the advantages of the injector equipped with the control valve according to the invention, it is possible for the valve body to be actuated by a piezoelectric actuator. This permits extremely rapid control movements. Because the seat in the housing and the valve cone on the valve body do not experience any appreciable wear thanks to the structural design of the control valve according to the invention, the function of the control valve is assured over the entire service life of the internal combustion engine despite the short adjusting paths of a piezoelectric actuator.

Preferably, the injector according to the invention is used in common rail fuel injection systems.

BRIEF DESCRIPTION OF THE DRAWINGS

Other advantages and advantageous embodiments will be described more fully herein below, with reference to the drawings, in which.

DESCRIPTION OF THE PREFERRED EMBODIMENTS

Figure 1:
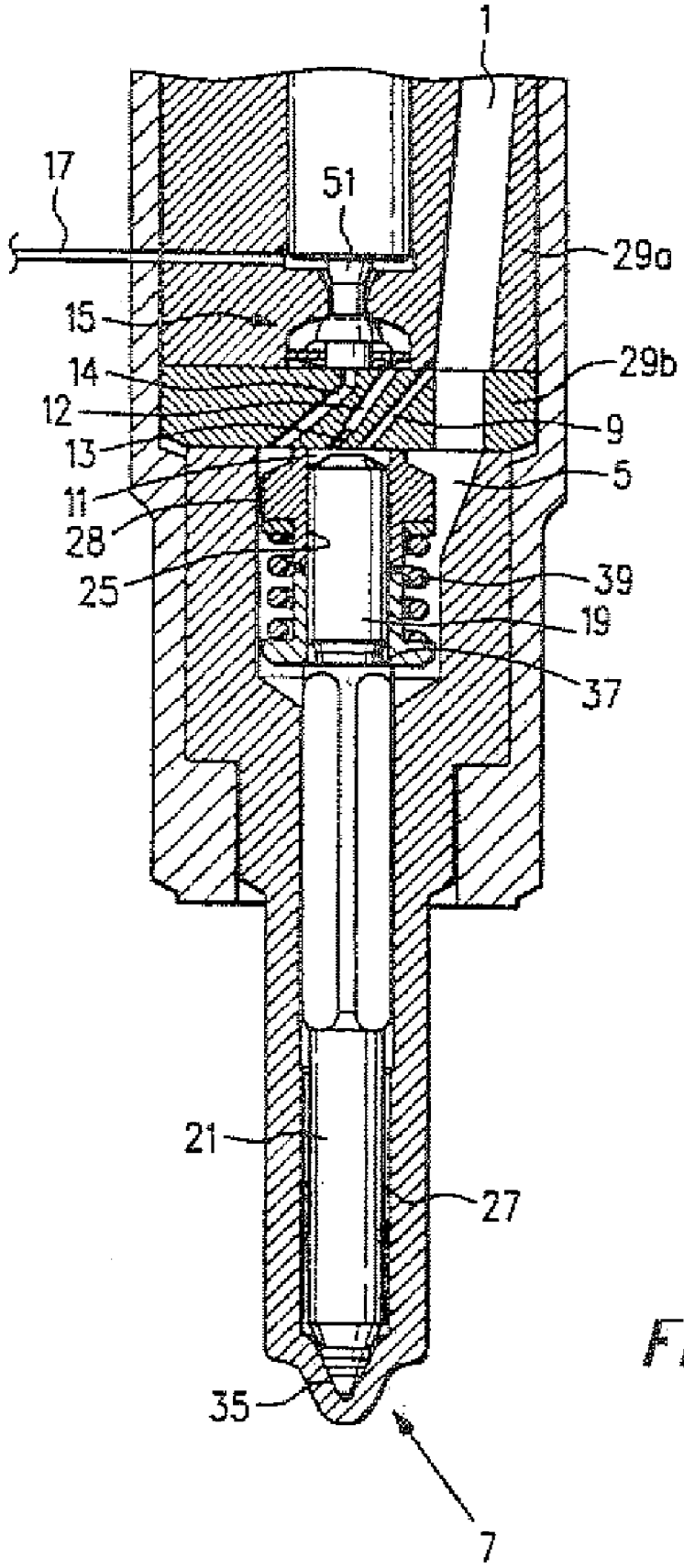
FIG. 1 is a schematic depiction of an injector embodying the invention.

FIG. 1 shows an injector with a control valve 15 according to the invention. By means of a high-pressure connection 1, fuel is conveyed through an inlet conduit 5 to an injection nozzle 7 and through an inlet throttle 9 to a control chamber 11. The control chamber 11 is connected to a fuel return 17 via an outlet conduit 12 and an outlet throttle 13. A bypass 14 produces a hydraulic connection between the inlet conduit 5 and an inlet of the control valve 15.

A control piston 19 delimits the control chamber 11. The control piston 19 is adjoined by a nozzle needle 21 that prevents the pressurized fuel from flowing into the combustion chamber, not shown, between injections. The control piston 19 and nozzle needle 21 can also be integrally joined to each other. The nozzle needle 21 has a cross-sectional change from a larger diameter 25 to a smaller diameter 27. The nozzle needle 21 is guided with its larger diameter 25 in a sleeve 28.

When the outlet throttle 13 is closed, the hydraulic force acting on an end surface 33 of the control piston 19 is greater than the hydraulic force acting on the cross-sectional change because the area at the end of the control piston 19 is greater than the annular area of the cross-sectional change. As a result, the nozzle needle 21 is pressed into a nozzle needle seat 35 and seals the inlet conduit 5 off from the combustion chamber, not shown.

If the high-pressure pump, not shown, of the fuel injection system is not driven because the engine is not running, then a nozzle spring 39, which acts on the shoulder 37 of the nozzle needle 21, presses the injection nozzle 7 against the nozzle needle seat 35 so that the injector is closed.

If, through a suitable triggering of the control valve 15, a hydraulic connection is produced between the outlet throttle 13 and the fuel return 17, then this reduces the pressure in the control chamber 11 and therefore also the hydraulic force acting on the end surface 33 of the control piston 19. As soon as this hydraulic force is less than the hydraulic force acting on the cross-sectional change, the nozzle needle 21 opens so that the fuel 3 can travel through the injection ports, not shown, into the combustion chamber. This indirect triggering of the nozzle needle 21 via a hydraulic power boosting system is necessary because the forces required to rapidly open the nozzle needle 21 cannot be produced directly with the control valve 15. The so-called "control quantity", which is required in addition to the fuel quantity injected into the combustion chamber, travels into the fuel return 17 via the inlet throttle 9, the control chamber 11, and the control valve 15. Between the injections, the control valve 15 closes the outlet throttle 13. The control valve 15 can be actuated by means of electromagnetic or piezoelectric actuators.

Figure 2:
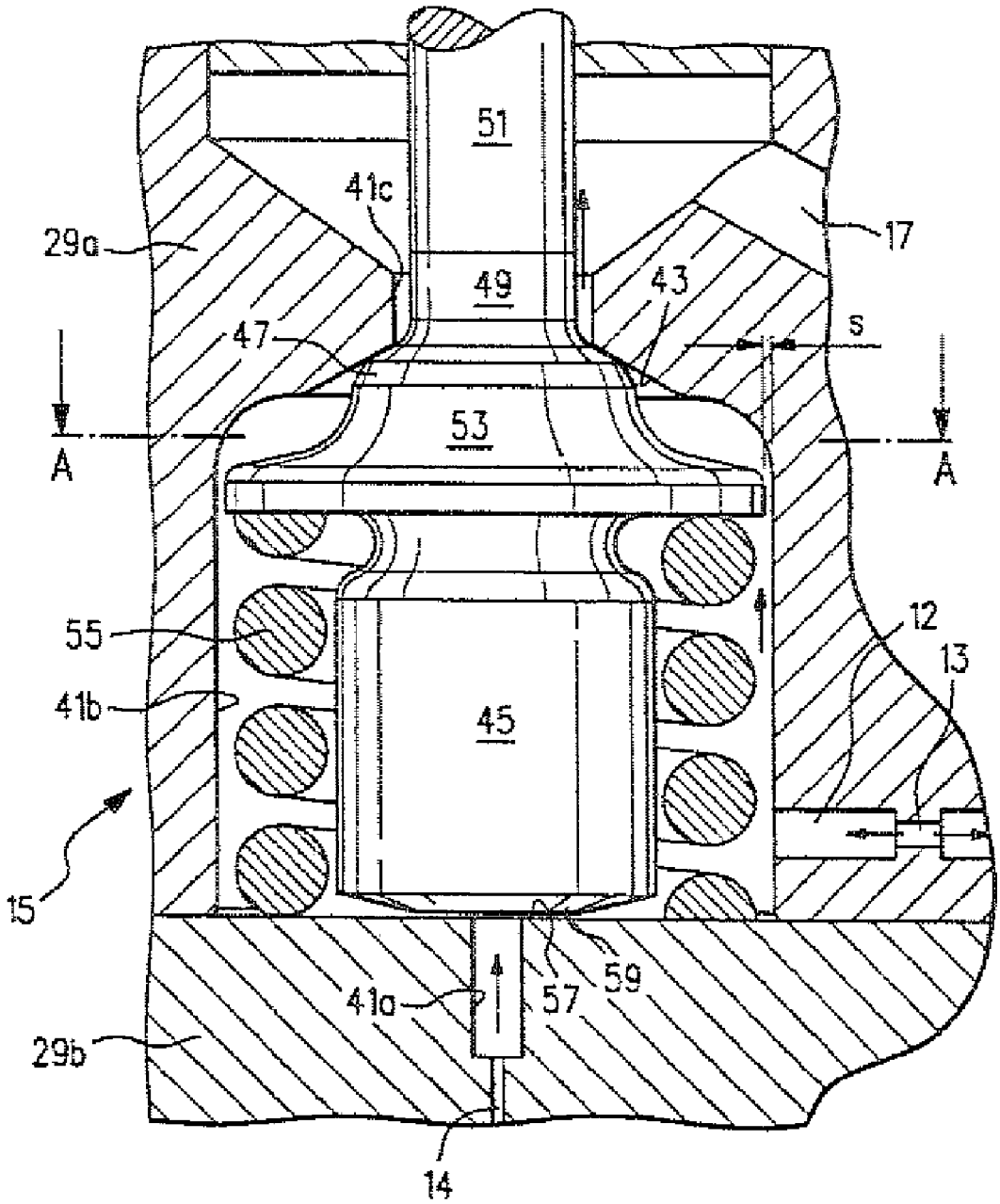
FIGS. 2-5 show exemplary embodiments of control valves according to the invention.

FIG. 2 is an enlarged depiction of a first exemplary embodiment of a control valve 15 according to the invention. The two-part housing, which is comprised of the parts 29*a* and 29*b*, has a stepped bore 41. A first section 41*a* of the stepped bore constitutes the bypass 14 of the control valve 15. This bypass 14 is hydraulically connected to the inlet conduit 5 of the injector (not shown). A second section 41*b* constitutes a spring chamber, while a third section 41*c* of the stepped bore 41 constitutes the outlet of the control valve 15. This outlet is hydraulically connected to the fuel return 17 (see FIG. 1).

The second section 41*b* of the stepped bore is connected to the outlet conduit 12, which is equipped with an outlet throttle 13. The outlet conduit 12 starts in the control chamber 11 of the injector.

A first valve seat 43 is embodied between the sections 41*b* and 41*c* of the stepped bore 41. A valve body 45 is provided with a valve cone 47 that cooperates with the first valve seat 43. Above the valve cone 47, the valve body 45 has a stump 49 whose end surface rests against a plunger 51 of a piezoelectric actuator (not shown). Below the valve cone 47, the valve body 45 is provided with a spring plate 53. Between the spring plate 53 and the housing part 29*b*, a closing spring 55 is clamped, which presses the valve body 45 against the first valve seat 43 and/or against the plunger 51 of the piezoelectric actuator, not shown. In the first switched position of the control valve 15 shown in FIG. 2, the piezoelectric actuator (not shown) is not supplied with current so that the valve cone 47 of the valve body 45 rests against the first valve seat. As a result, the control valve 15 is closed. The valve body 45 is thus clamped between the plunger 51 and the closing spring 55.

The exemplary embodiment of a control valve 15 according to the invention shown in FIG. 2 is embodied in the form of a double-switching control valve. To this end, at the transition between the first section 41*a* and section 41*b* of the stepped bore 41, a second valve seat 57 is provided, embodied in the form of a flat seat. This second valve seat 57 cooperates with an end surface 59 of the valve body 45. In the switched position of the control valve 15 shown in FIG. 2, there is a hydraulic connection between the inlet conduit 5 and the control chamber 11 via the bypass 14, the outlet conduit 12, and the outlet throttle 13.

When the piezoelectric actuator, not shown is supplied with current, the plunger 51 moves downward in FIG. 2 so that the valve cone 47 of the valve body 45 lifts away from the first valve seat 43 and, during the switching phase, a hydraulic connection is temporarily produced between the section 41*a* of the stepped bore and the fuel return 17. If the valve body 45 is then moved toward the second valve seat 57 until the end surface 59 of the valve body 45 comes into contact with the second valve seat, then the hydraulic connection between the section 41*a* of the stepped bore, i.e. the bypass 14, and the fuel return 17 is closed again. When the first valve seat 43 is open and the second valve seat 57 is closed, the outlet throttle 13 is open.

If the valve body 45 is kept in this second switched position (not shown), then the hydraulic connection between the outlet throttle 13 and the fuel return 17 is opened. As long as this hydraulic connection exists, the nozzle needle 21 of the injector lifts away from its nozzle needle seat so that fuel is injected into the combustion chamber of the engine.

If the first valve seat 43 is closed again, then a hydraulic connection exists between the section 41*a* of the stepped bore, i.e. the bypass 14, and the outlet conduit 12, as a result of which the control chamber 11 is filled with fuel from both the inlet throttle 9 and the bypass 14. This achieves a rapid closing of the nozzle needle 41.

In the control valve 15 according to the invention, the diameter of the spring plate 53, for example, is matched to the diameter of the second section 41*b* of the stepped bore 41 so that a very small gap s remains between the spring plate 53 and the second section 41*b* of the stepped bore. This gap s is dimensioned so that the valve body 45 is laterally guided in such a way that the valve cone 47 always comes into contact with the valve seat 43 in the same place when the control valve 15 is closed. This significantly reduces slippage and therefore wear on the valve cone 47 and the first valve seat 43.

On the other hand, the gap s must be dimensioned as large enough so that the valve cone 47 centers itself in the first valve seat 43. The guidance of the valve body 45 on the outer diameter of the spring plate 53 should only prevent the valve body 45 from appreciable lateral deflection. If such a lateral deflection were to occur during operation of the engine, then the valve cone 47 would contact the valve seat 43 in an off-center fashion, which could result in local overstressing. The force of the closing spring 55 would then center the valve body 45 in the first valve seat 43. The relative movement thus occurring between the first valve seat 43 and the valve cone 47 (slippage) generates wear on the components involved so that the stroke of the valve body 45 between the first switched position and the second switched position changes significantly over the service life of the engine. This results in an impaired operating behavior and possibly even malfunctions since, as is known, the adjusting path of piezoelectric actuators is relatively small. In concrete embodiments, a thickness of the gap s of less than 0.1 mm has turned out to be advantageous.

Figure 2A:
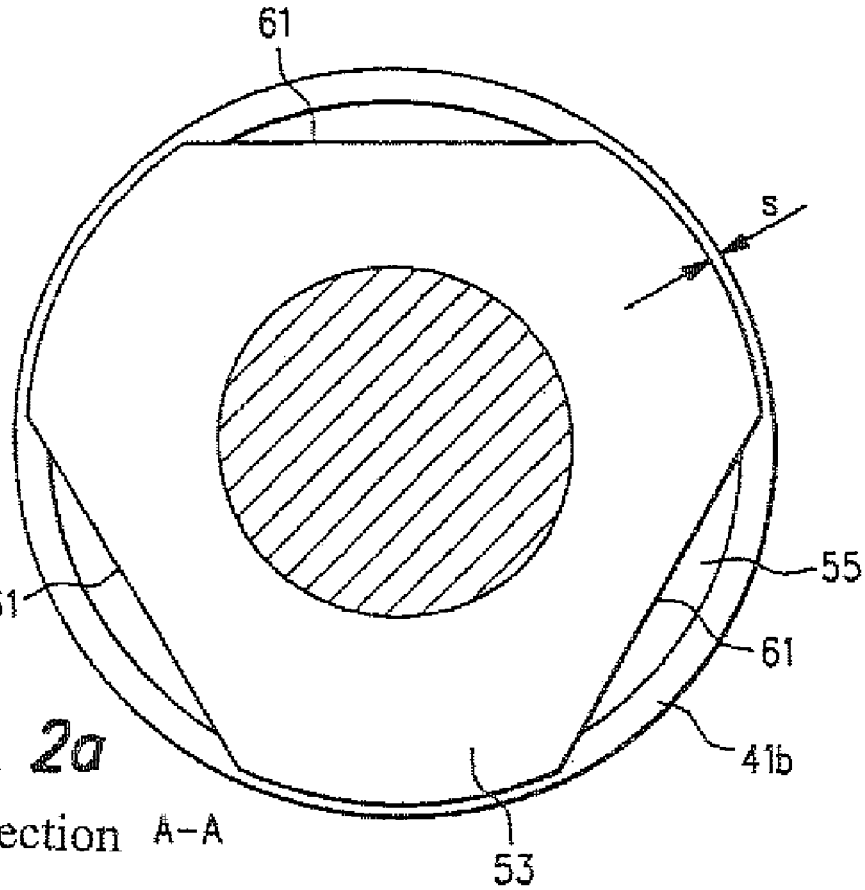
Figure 2B:
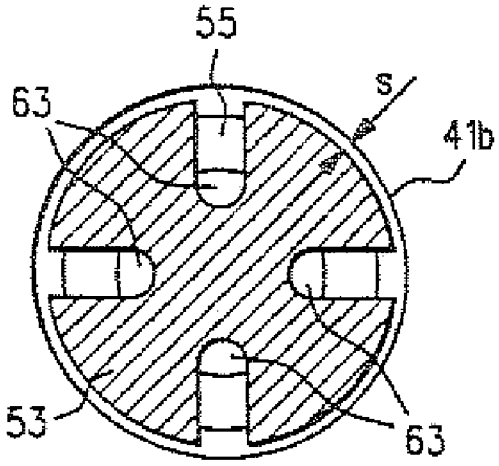
Figure 2C:
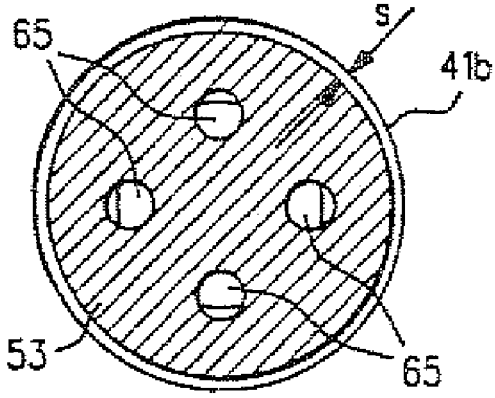

FIG. 2*a* shows a top view of the spring plate 53 along the line A-A in FIG. 2. It is clear from this depiction that the gap s is not present over the entire circumference of the spring plate, but instead, the spring plate 53 has three flattened regions 61. These flattened regions 61 make it possible for the control quantity to flow out past the spring plate 53. FIGS. 2*b* and 2*c* show other embodiment forms of passages according to the invention. In the exemplary embodiment shown in FIG. 2*b*, the spring plate 53 is provided with four radially oriented grooves 63, while in the exemplary embodiment shown in FIG. 2*e*, the spring plate 53 is provided with four bores 65.

Figure 3:
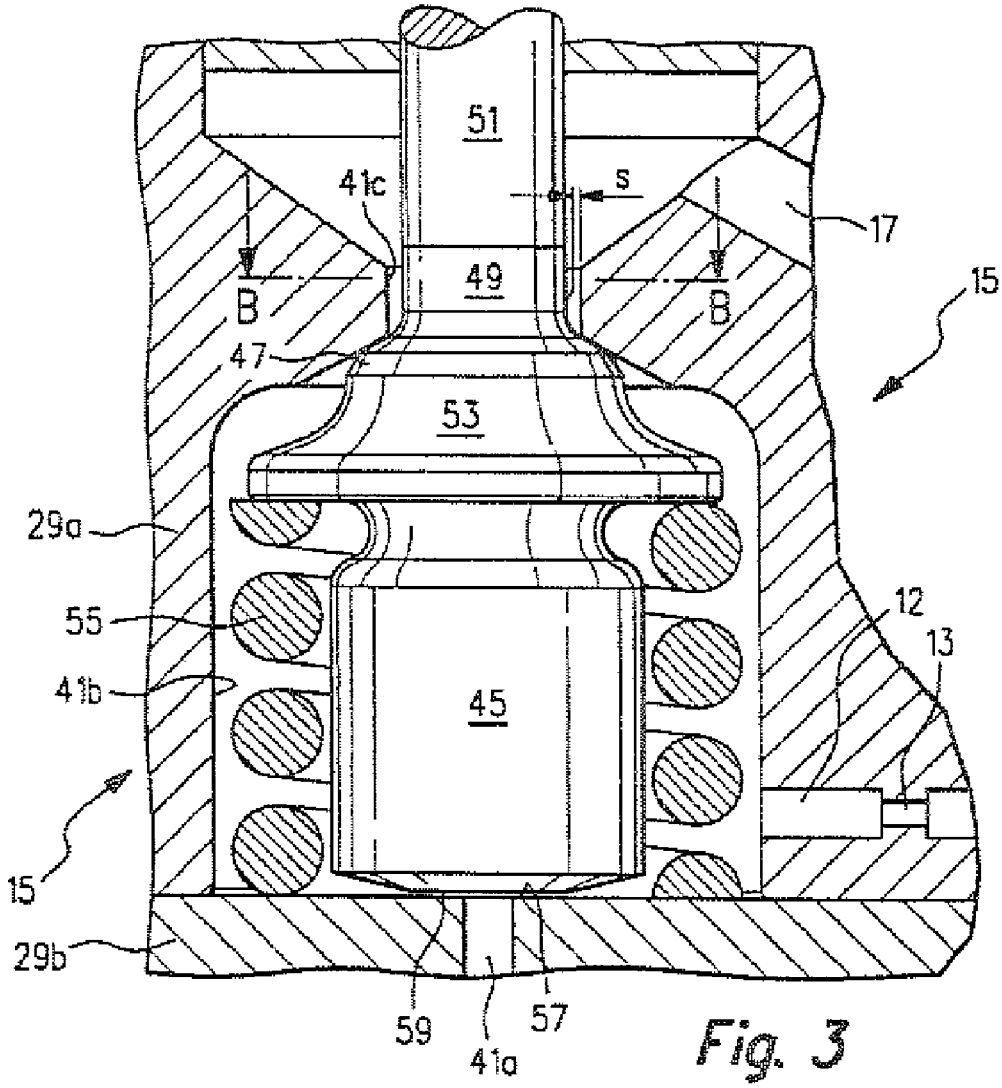

In the exemplary embodiment shown in FIG. 3, the valve body 45 is guided in the third section 41*c* of the stepped bore 41. This means that the diameter of the plunger 49 is selected so that once again a gap is formed, this time between the plunger 49 and the third section 41*c* of the stepped bore 41. Here, it has turned out to be advantageous if the gap s is smaller than 0.05 mm.

Figure 3A:
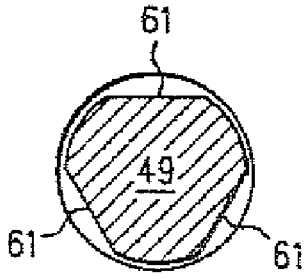
Figure 3B:
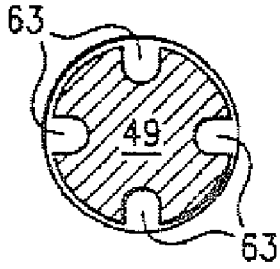

In this exemplary embodiment as well, passages must be provided in the valve body 45 in the region in which the valve body 45 is guided in the stepped bore 41. FIGS. 3*a* and 3*b* show sectional depictions along the line B-B of FIG. 3 of two different embodiments of a plunger 49 according to the invention. In the exemplary embodiment shown in FIG. 3*a*, flattened regions 61 are provided, while in the exemplary embodiment shown in FIG. 3*b*, grooves 63 are provided, which extend over the entire length of the guide section between the plunger 49 and the third section 41*c* of the stepped bore 41. Naturally, the invention is not limited to the forms of the flattened regions 61, grooves 63, and bores 65 that are explicitly shown.

Figure 4:
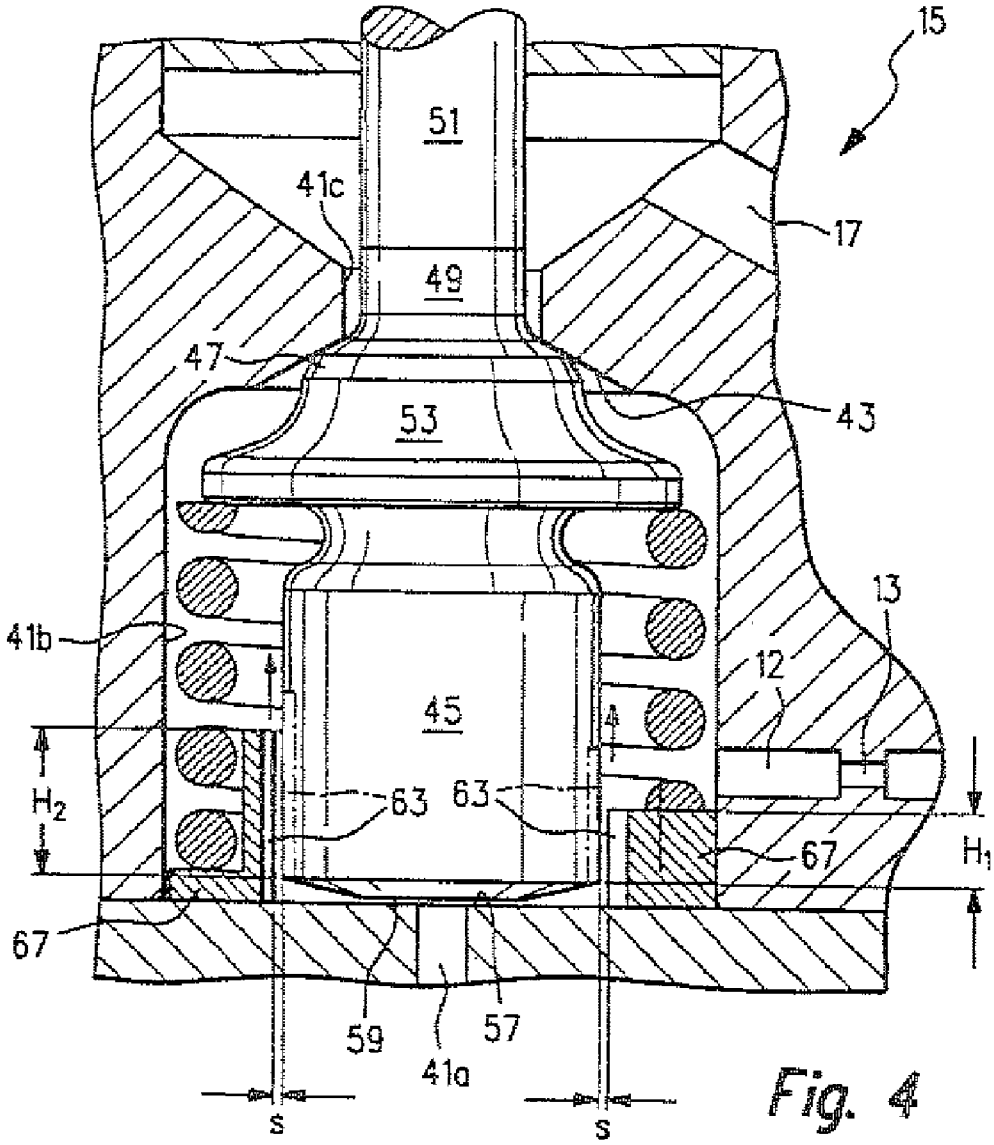
Figure 4A:
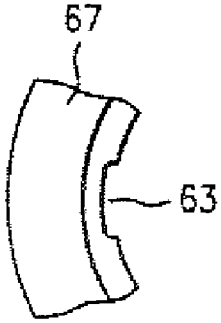
Figure 4B:
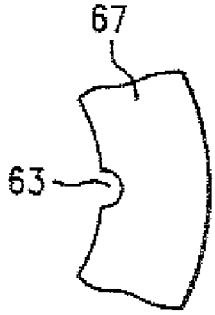

FIG. 4 shows another exemplary embodiment of a control valve 15 according to the invention. In this exemplary embodiment, the valve body 45 is guided by means of a sleeve 67 in the region of the section 41*b* of the stepped bore 41.

On the right side of FIG. 4, the sleeve 67 is embodied in the form of ring with an approximately square cross section, while on the left side, the sleeve 67 has an L-shaped cross section. The essential difference between these two embodiments lies in the overlap $H_1$ and $H_2$ between the valve body 45 and the sleeve 67.

In order to be able to drain off the control quantity when the control valve 15 is open, despite the narrow gap s between the inner diameter of the sleeve 67 and the outer diameter of the valve body 45, longitudinal grooves 63 are provided in the sleeve 67 and/or the valve body 45. The detail views 4*a* and 4*b* show two different cross-sectional forms of the grooves 63. Which of these forms is preferable depends on the available space and the control quantity to be drained off.

Figure 5:
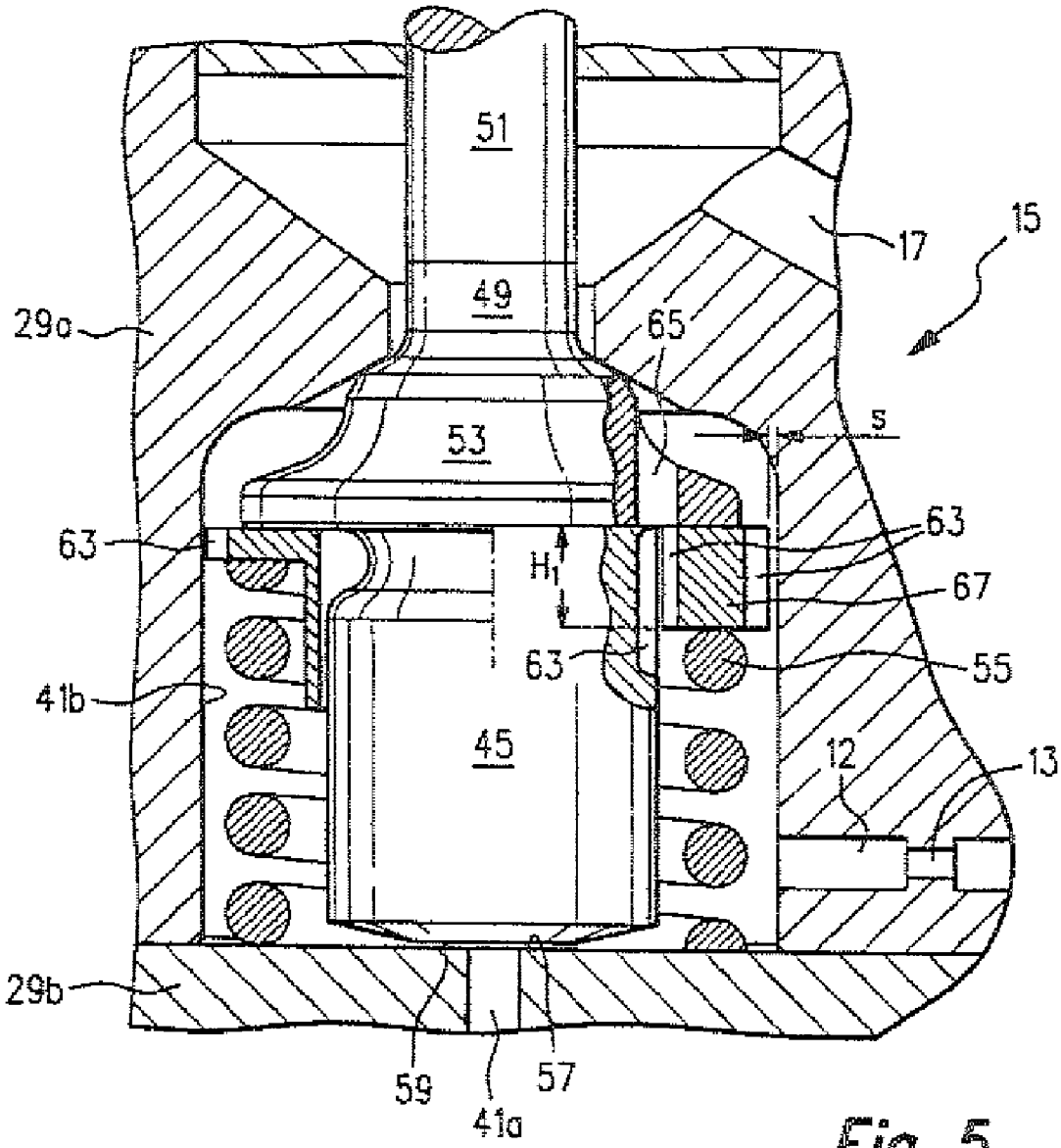
Figure 5A:
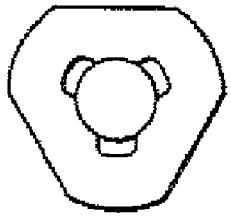

FIG. 5 shows another exemplary embodiment of a control valve 15 according to the invention. In this exemplary embodiment, the sleeve 67 is situated between the spring plate 53 and the closing spring 55. In FIG. 5 as well, two different forms of sleeve 67 are shown on the right and left side. The common trait shared by the two embodiments is that the passages are embodied in the form of grooves 63. In the embodiment shown on the right side in FIG. 5, grooves 63 are also provided in the valve body 45. The spring plate 53 also has bores 65 that likewise permit the control and leakage quantity coming from the injector (not shown) to drain out through the control valve 15 and into the fuel return 17.

The foregoing relates to a preferred exemplary embodiment of the invention, it being understood that other variants and embodiments thereof are possible within the spirit and scope of the invention, the latter being defined by the appended claims.

The invention claimed is:

1. In an injector for an internal combustion engine, the injector comprising a control valve for opening and closing a nozzle needle, the control valve including a housing and an actuator, the housing containing an inlet conduit, a stepped bore with a spring chamber for accommodating a valve body, one section of the stepped bore being embodied as a bypass, one section of the stepped bore being embodied as an outlet, and an outlet conduit being connected to a second section of the stepped bore, the injector further comprising a closing spring, a first valve seat and a valve cone, the valve cone cooperating with the first valve seat and the valve body being pressed against a plunger of the actuator by the closing spring contained in the spring chamber, guide means in at least one section of the stepped bore guiding the valve body, and one or more passages in the at least one section for the control quantity of the injector.

2. The injector according to claim 1, wherein the control valve comprises an inlet connected to the inlet conduit of the injector.

3. The injector according to claim 1, wherein the outlet is connected to a fuel return.

4. The injector according to claim 2, wherein the outlet is connected to a fuel return.

5. The injector according to claim 1, wherein the closing spring acts on the valve body in the direction opposite from the actuating direction of the actuator.

6. The injector according to claim 2, wherein the closing spring acts on the valve body in the direction opposite from the actuating direction of the actuator.

7. The injector according to claim 3, wherein the closing spring acts on the valve body in the direction opposite from the actuating direction of the actuator.

8. The injector according to claim 5, wherein the closing spring is supported at least indirectly against the housing and against a spring plate of the valve body.

9. The injector according to claim 1, wherein the valve body is guided in the region of the outlet and/or in the region of the spring chamber.

10. The injector according to claim 4, wherein the valve body is guided in the region of the outlet and/or in the region of the spring chamber.

11. The injector according to claim 8, wherein the valve body is guided in the region of the outlet and/or in the region of the spring chamber.

12. The injector according to claim 8, wherein the valve body is guided on the spring plate.

13. The injector according to claim 9, wherein the valve body is guided on the spring plate.

14. The injector according to claim 8, further comprising a sleeve in the spring chamber, the sleeve guiding the valve body.

15. The injector according to claim 1, wherein the passage or passages are embodied in the form of grooves, flattened regions, and/or longitudinal bores extending in the longitudinal direction of the valve body.

16. The injector according to claim 2, further comprising a second valve seat at the transition between the inlet and the spring chamber, an end surface of the valve body cooperating with the second valve seat.

17. The injector according to claim 1, wherein the housing is comprised of two parts.

18. The injector according to claim 1, wherein the control valve is a ⅔-way control valve.

19. The injector according to claim 1, wherein the actuator is a piezoelectric actuator.

20. The injector according to claim 1, wherein the injector is used in a common rail fuel injection system.

* * * * *